US005605128A

United States Patent [19]

Nusser et al.

[11] Patent Number: 5,605,128

[45] Date of Patent: Feb. 25, 1997

[54] METHOD AND ARRANGEMENT FOR IDLE ADJUSTMENT OF AN INTERNAL COMBUSTION ENGINE

[75] Inventors: Claus-Dieter Nusser, Schwieberdingen; Helmut Sperling, Gifhorn, both of Germany

[73] Assignee: Robert Bosch GmbH, Stuttgart, Germany

[21] Appl. No.: 478,773

[22] Filed: Jun. 7, 1995

[30] Foreign Application Priority Data

Sep. 19, 1994 [DE] Germany ..... 44 33 300.5

[51] Int. Cl.[6] ..... F02M 3/00

[52] U.S. Cl. ..... 123/339.24

[58] Field of Search ..... 123/339.24, 349, 123/480

[56] References Cited

U.S. PATENT DOCUMENTS

| | | | |
|---|---|---|---|
| 4,345,557 | 8/1982 | Ikeura | 123/339.24 |
| 4,393,834 | 7/1983 | Doherty, Jr. | 123/339.24 |
| 4,688,534 | 8/1987 | Takeda et al. | 123/339.24 |
| 4,763,623 | 8/1988 | Sasaki | 123/339.24 |
| 5,002,026 | 3/1991 | Ohkumo et al. | 123/339.24 |

*Primary Examiner*—Raymond A. Nelli
*Attorney, Agent, or Firm*—Walter Ottesen

[57] ABSTRACT

A method and an arrangement for adjusting the idle of an internal combustion engine are suggested wherein the idle rpm is increased when the engine is hot. A hot engine is then present when the engine temperature and the intake-air temperature have exceeded predetermined threshold values and the engine rpm has been above a limit rpm for a pregiven time.

11 Claims, 2 Drawing Sheets

METHOD AND ARRANGEMENT FOR IDLE ADJUSTMENT OF AN INTERNAL COMBUSTION ENGINE

BACKGROUND OF THE INVENTION

If an internal combustion engine is operated for a longer time duration in the full-load range and then is braked into the idle range, the problem is presented that the engine overhears when the idle rpm, which is usually adjusted, is maintained unchanged. An oil pressure which is too low in order to ensure adequate lubrication of the engine occurs especially because of the high oil temperatures which are then present.

To prevent the above and similar unwanted situations, U.S. Pat. No. 4,345,557 discloses that the idle speed adjustment of an internal combustion engine is carried out in the context of an idle rpm control and the desired value of this control is inputted in dependence upon the coolant temperature of the engine in such a manner that the rpm is increased in the so-called hot idle state above a predetermined engine or coolant temperature. The cooling action is amplified in this way.

U.S. Pat. No. 5,002,026 discloses the application of the oil temperature for adjusting the idle in the normal operating range. The oil temperature is determined from other variables in order to avoid the expense of providing an oil-temperature sensor. For this purpose, the time span is determined during which the coolant temperature is equal to or greater than a temperature threshold. A measure or quantity for the oil temperature is determined from a pre-given relationship between this time span and the oil temperature and the idle rpm is correspondingly adjusted. However, measures are not disclosed which, in combination with the so-called hot idle, determine the threatening drop of the oil pressure.

SUMMARY OF THE INVENTION

In view of the above, it is an object of the invention to provide a method and an arrangement which make it possible to increase the idle rpm when the operating state of the so-called hot idle is reached wherein a low oil pressure threatens to occur.

With the method and arrangement of the invention, the operating state of hot idle can be satisfactorily controlled. Here, the method and arrangement of the invention make it possible to increase the idle rpm when the oil pressure threatens to become too low. It is especially advantageous that the invention permits detecting when an oil-temperature threshold is exceeded above which an oil pressure threatens to occur which is too low. This is done without utilizing an oil-temperature sensor.

For the increase in oil temperature, the time for which the engine is operated at high rpm is essential. Here, and in an advantageous manner, an increase above the oil temperature threshold is estimated on the basis of a time span, which is formed from the rpm, the engine temperature and the intake-air temperature.

For the determination of this time span, it is especially advantageous to apply the time for which the engine is operated at an rpm above a limit rpm. It is in this context advantageous to consider the time for which the engine is operated at an rpm below a limit rpm.

An essential advantage is that no lines and pins must be provided on the control apparatus because of the simulation of the oil temperature. Furthermore, no evaluation circuits and evaluation programs for the oil-temperature sensor signal are needed in the engine-control unit.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
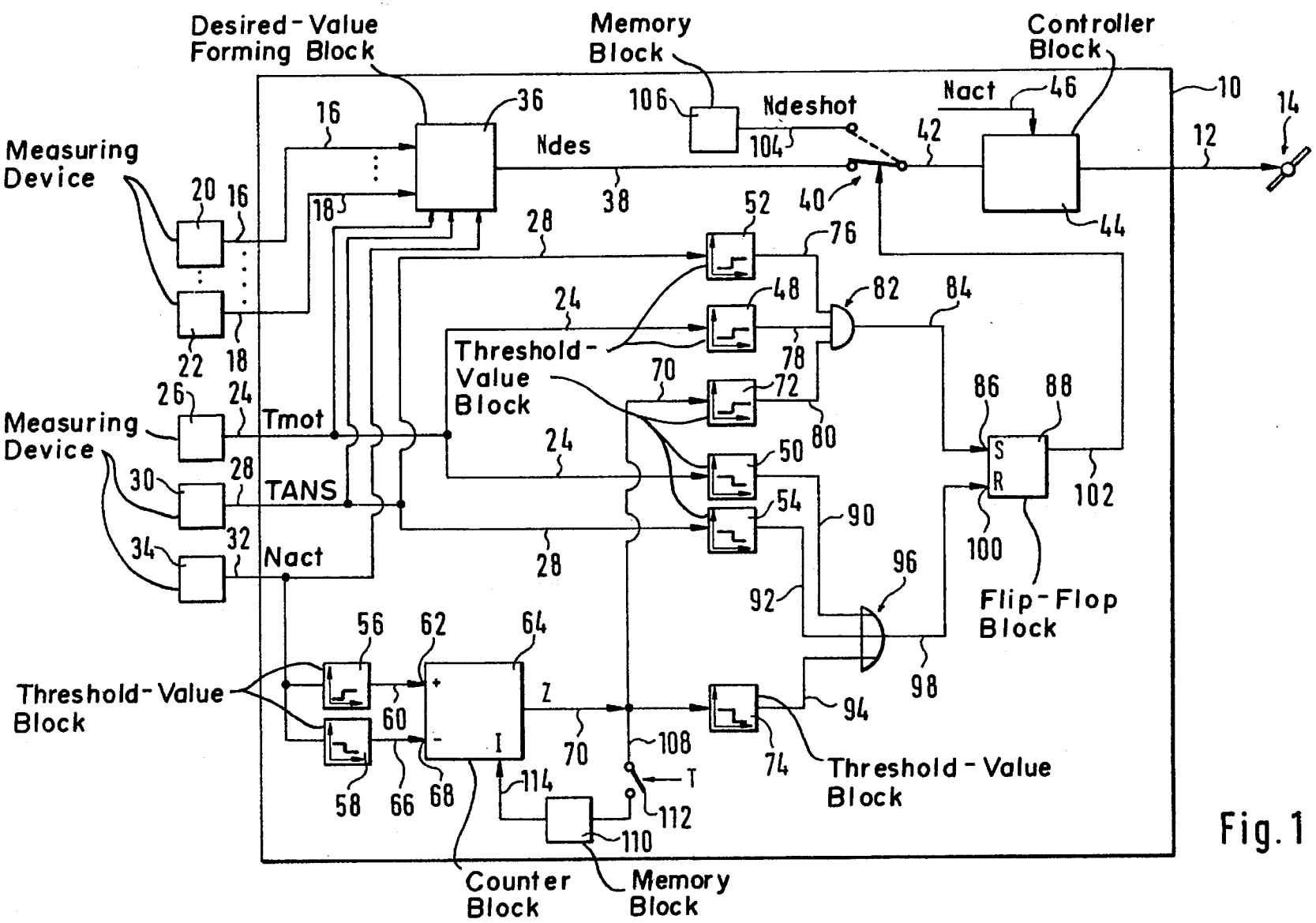
FIG. 1 is an schematic diagram of an arrangement according to the invention wherein the operation of a microcomputer of the arrangement is shown by a functional block diagram; and, FIG. 2 is a flowchart for realizing the method of the invention in the context of a computer program.

FIG. 1 shows a control unit 10 which actuates functions (not shown) such as fuel metering and ignition adjustment as well as an actuating element 14 for adjusting at least the idle air to the engine. The control unit 10 is a microcomputer and the elements within the region enclosed by box 10 are function blocks to provide an illustrative example of the functions performed by the microcomputer. The actuation of element 14 takes place via output line 12 as well as other output lines which are not shown for the sake of clarity. The control unit 10 is connected via input lines 16 to 18 to measuring devices 20 to 22, respectively, for detecting operating variables of the engine and/or of the motor vehicle. The control unit 10 is also connected via the input line 24 to a measuring device 26 for detecting engine temperature (cooling-water temperature) and is connected via a line 28 to a measuring device 30 for detecting the temperature of the intake air. The control unit 10 is also connected via a line 32 to a measuring device 34 for detecting engine rpm.

The input lines 16 to 18 lead to a desired-value forming block 36 having an output line 38 connected to a switch element 40.

In an advantageous embodiment, at least one of the lines 24, 28 and 32 is likewise connected to the desired-value forming block 36. A line 42 leads from the switch element 40 to a controller block 44 to which the engine rpm is supplied via a line 46. The line 12 is the output line of the controller block 44. The line 24 leads, on the one hand, to a threshold-value block 48 while, on the other hand, to a further threshold-value block 50. The line 28 also leads, on the one hand, to a threshold-value block 52 while, on the other hand, to a threshold-value block 54. The line 32 leads to a threshold-value block 56 and to a threshold-value block 58.

The output line 60 of the threshold-value block 56 leads to the incrementing input 62 of a counter block 64 and the output line 66 of the threshold-value block 58 leads to the decrementing input 68 of the counter block 64.

The output line 70 of the counter block 64 leads, on the one hand, to a threshold-value block 72 while, on the other hand, to a further threshold-value block 74.

The output line 76 of the threshold-value block 52, the output line 78 of the threshold-value block 48 and the output line 80 of the threshold-value block 72 all lead to a logic AND-gate 82 having an output line 84 connected to a set input 86 of an element 88 defining a flip-flop function.

The output line 90 of the threshold-value block 50, the output line 92 of the threshold-value block 54 and the output line 94 of the threshold-value block 74 all lead to a logic OR-gate 96 having an output line 98 leading to the reset input 100 of element 88. The output line 102 of element 88 leads to the switch element 40. In its second switching position (shown by the broken line), the switch element 40 connects the line 42 to a line 104. Line 104 extends from a memory block 106 for storing the desired idle rpm Ndeshot during the hot idle state.

Furthermore, a line 108 leads from line 70 to a memory block 110 in which the output value of the counter block 64 is stored at pregiven time points (symbolized by switch element 112). When switching on the ignition, this permanently stored value is loaded via the line 114 into the counter block 64.

In the normal operation of the control arrangement shown in FIG. 1, the desired-value forming block unit 36 forms an idle speed rpm desired value Ndes in dependence upon the operating variables supplied thereto such as transmission position, battery voltage, et cetera as well as operating values such as engine rpm, cooling-water temperature and intake-air temperature. The idle rpm desired value Ndes is adjusted by the controller unit utilizing a comparison to the actual rpm by actuating the positioning device 14. The controller can, for example, be a PID-controller. In the so-called hot idle, the switch element 40 is switched into the position shown by the broken line under the conditions described below and the idle rpm is adjusted on the basis of the desired value provided for this operating state.

The switchover to the higher desired value during hot idle takes place when there is a danger that the oil pressure will drop to low values. The higher desired value is greater in amount compared to the rpm desired value in normal operation. The danger of a drop in the oil pressure is detected when an increase of the oil temperature above a threshold value is computed.

The switchover signal is formed when the engine temperature and the intake-air temperature are above a pregiven limit value and, in the simplest case, the engine is operated for a pregiven time at an rpm above a limit rpm. In a preferred embodiment, the time at which the engine is operated below the limit rpm is also considered and so, as a supplementary criterion, the cooling down of the oil when there is a drop below the limit rpm is applied by subtracting this time.

The counter block 64 is initialized and preferably set to the value 0 when the control arrangement 10 is first taken into service after interruption of the current supply (so-called original start). The counter value of the counter is increased at regular time intervals (for example, 10 seconds), preferably by 1, when the actual rpm exceeds the limit value (for example, 4,800 rpm) pregiven in the threshold-value block 56. The counter value of the counter block 64 is decremented at regular time intervals (for example, 10 seconds) when the actual rpm drops below the limit value pregiven in the threshold-value block 58. This limit value is preferably identical to the limit value pregiven in the threshold-value block 56.

The counter value Z formed in this way is emitted via the line 70 and is stored permanently in the memory element 110 at pregiven time points. For a normal start of the internal combustion engine, the counter value permanently stored in the memory element 110 is loaded into the counter block 64. Accordingly, the stored counter value is always the starting point.

The counter value Z is a measure for a time duration dependent upon the engine rpm and the engine load.

The time duration is determined from the time for which the rpm has exceeded specific threshold values reduced by the time for which the engine is operated below the limit value. The time duration then defines a measure for the time for which the engine is operated at high rpm. Here it is to be noted that the counter value is limited to a minimum value and to a maximum value.

The values of cooling-water temperature Tmot, the intake-air temperature TANS as well as the counter value Z are supplied to the threshold-value blocks 48, 52 and 72 and are compared therein to pregiven threshold values. When the particular threshold value is exceeded, a corresponding signal is emitted via the lines 76, 78 and 80. If all three operating variables exceed the particular pregiven threshold value, then the logic AND-gate 82 generates a corresponding signal via the line 84 which sets the element 88. Correspondingly, the element 88 changes its output signal level on the line 102 and leads to the switchover of the switch element 40.

The operating state hot idle is then detected when the engine temperature and the intake-air temperature have exceeded predetermined threshold values as well as when the rpm is greater than a threshold value for a specific time duration. Stated otherwise, the time duration for which the rpm is greater than the limit rpm is compared to a threshold which is dependent upon the history of the course of the rpm as a function of time. Examples for the limit values in an embodiment are 4,800 rpm for the engine speed, 100° C. for the engine temperature and 60° C. for the intake-air temperature. The limit value is, for example, reached after 15 minutes when the rpm is continuously high.

In this connection, it is noted that the numeral range of the counter block 64 is limited by maximum and minimum values and that the operating state of hot idle can be set only outside of the start phase. The element 88 is reset with each start of the internal combustion engine in order to provide a defined starting point.

If the operating variables of cooling-water temperature, intake-air temperature and counter value drop below the threshold values pregiven in the threshold-value blocks 50, 54 and 74, the respective threshold-value blocks then generate a signal level on the lines 90, 92 and 94. The logic OR-gate 96 then generates an output signal on the line 98. This output signal leads to the reset of the element 88 and to switching the switch element 40 into the position represented by the solid line when at least one of the above-identified operating variables drops below the pregiven threshold value. Then, the operating state of hot idle is recognized as being ended.

Personnel experienced in this area can realize the embodiment shown in FIG. 1 also with other switching means and obtain the desired function.

Figure 2:
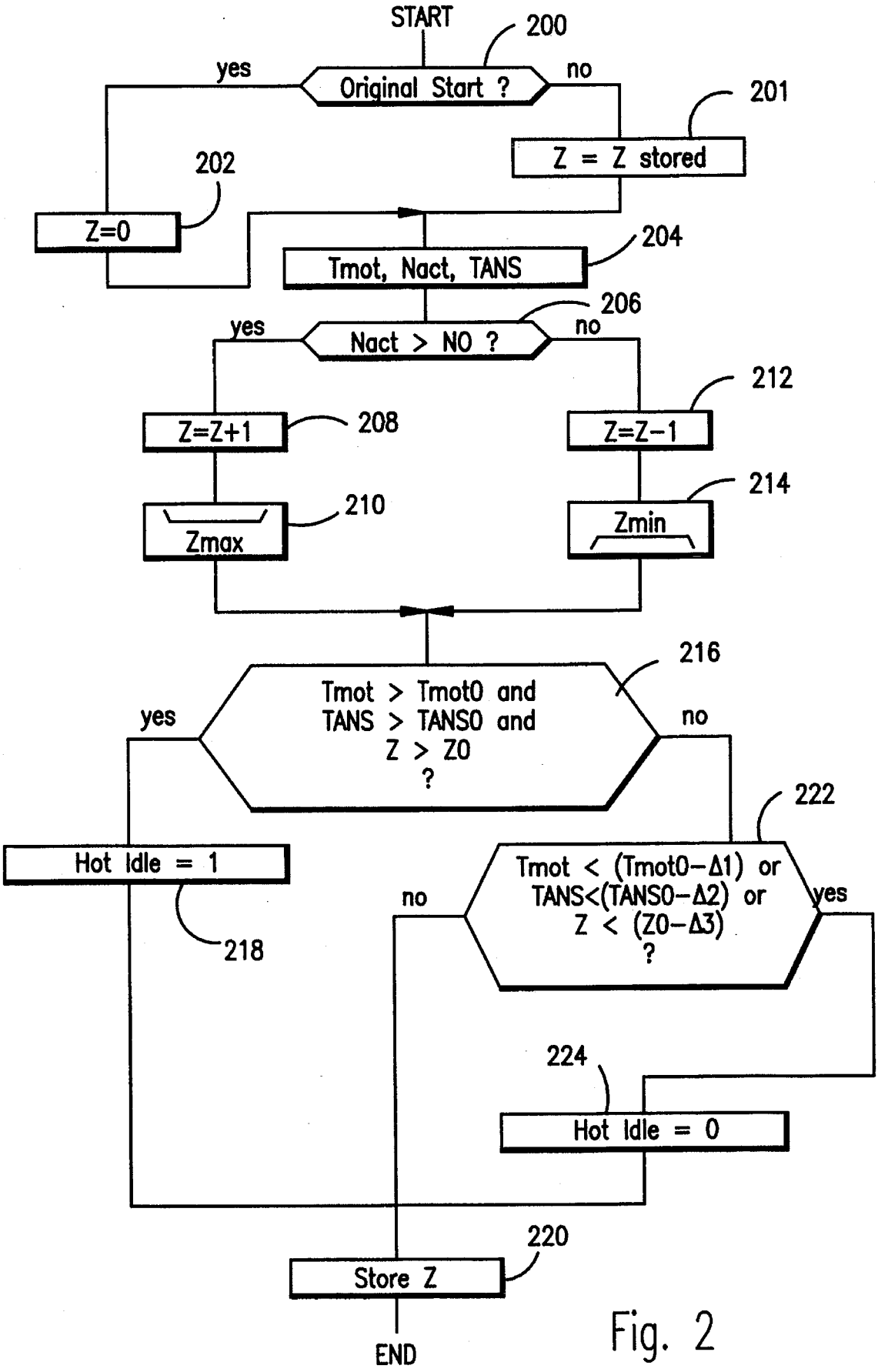

FIG. 2 is a flowchart of an embodiment of the method of the invention realized in the context of a computer program. The subprogram shown in FIG. 2 is called up at pregiven time points. In one embodiment, it has been shown that the call-up of the subprogram every 10 seconds is a suitable value.

After the start of the subprogram according to FIG. 2, an inquiry is made in a first step 200 with respect to a mark as to whether an original start condition is present. If this is the case, then the counter value Z is set to 0 in accordance with step 202. If no original start condition is present, then the stored counter value Z is loaded in step 201. After step 201 or 202, the cooling-water temperature Tmot, the engine rpm Nact and the intake-air temperature TANS are read in in step 204. In the next inquiry step 206, an inquiry is made as to whether the actual engine rpm has exceeded a pregiven threshold value NO. If this is the case, the counter is incremented in step 208, that is, the counter is increased by 1 and, if necessary, in the next step 201, the counter is limited to its maximum value Zmax. If the engine rpm is equal to or less than the pregiven threshold value N0, then in step 212, the counter is decremented, that is, the counter value Z is reduced by 1 and, in the next step 214, the counter value Z is limited to the minimum value Zmin if required.

Thereafter, in inquiry step 216, a check is made as to whether: the cooling-water temperature has exceeded the threshold value Tmot0, the intake-air temperature has exceeded a threshold value TANS0 and whether the counter value is greater than a counter threshold value Z0. If all these conditions are present at the same time, then, in step 218, a mark for the operating state of hot idle is set. In the program of the idle rpm control, this leads to the situation that the idle rpm desired value Ndes is replaced by the desired value Ndeshot pregiven for this operating state.

After step 218, the counter value present is permanently stored in step 220 and the subprogram is ended. If a determination is made in step 216 that the three conditions are not simultaneously present, then a check is made in inquiry step 222 as to whether the cooling-water temperature Tmot is less than a threshold value (Tmot0–Δ1) or the intake-air temperature is less than a threshold value (TANS0–Δ2) or the counter value Z is less than a pregiven threshold value (Z0–Δ3). If this is not the case, then nothing has changed in the actual operating state of the internal combustion engine so that the program can be continued with step 220 and the storage of the counter value Z. If one of the conditions checked in step 222 is satisfied, then, in step 224, the movement of the operating state out of hot idle or the normal operating state of the idle control is detected and the hot idle mark is correspondingly changed or held at the value which it had up until now. This leads in the program of the idle control to the situation that the idle rpm desired value Ndes forms the basis of the control. The idle rpm desired value Ndes is dependent upon the operating variables. After step 224, the counter value is stored and the subprogram is ended.

In each case, it is advantageous to adjust the idle rpm desired value Ndes only in the next idle cycle after leaving the hot idle operating state so that the driver notices no rpm changes in an idle cycle.

In summary, the operating state hot idle is then detected when the engine temperature and the intake-air temperature and the time duration (for which the rpm has been above a limit rpm) have all exceeded respective threshold values. The operating state hot idle or a movement out of this operating state is not detected when the engine temperature or the intake-air temperature or the time duration are below respective pregiven threshold values. Hot idle is detected when, for example, and for a simultaneous presence of the other conditions, the rpm lies above the threshold for a long time. Here, a hysteresis is provided between the threshold values in order to avoid a continuous switching.

It is understood that the foregoing description is that of the preferred embodiments of the invention and that various changes and modifications may be made thereto without departing from the spirit and scope of the invention as defined in the appended claims.

What is claimed is:

1. A method for adjusting the idle speed of an internal combustion engine equipped with an adjusting device for adjusting the idle speed, the method comprising the steps of:

detecting operating variables of the engine including engine temperature (Tmot), intake-air temperature (TANS) and engine speed (Nact);

evaluating said operating variables in a microcomputer to determine an operating state of the engine defined by an oil temperature greater than an oil temperature threshold above which an oil pressure can occur which is too low to effect an improved cooling of the engine; and, generating a drive signal to drive said adjusting device to increase the idle speed when said operating state is determined to be present.

2. The method of claim 1, further comprising:

determining a time duration during which the engine has been operated at an engine rpm above a limit rpm;

assuming said oil temperature threshold to be exceeded when the engine temperature, the intake-air temperature and the time duration exceed predetermined limit values.

3. The method of claim 2 wherein, when determining said time duration, the time duration is subtracted during which the engine was driven at an engine rpm above a limit rpm for which the engine rpm is below the load threshold so that oil can cool down.

4. The method of claim 2, wherein a counter value is incremented to determine an rpm criterion and decremented when there is a drop below the limit rpm.

5. The method of claim 4, wherein said operating state of the hot engine is determined when said counter value exceeds a predetermined limit value and the engine temperature and the intake-air temperature exceed predetermined threshold values.

6. The method of claim 2, wherein said operating state of the hot engine is viewed as not being reached or viewed as having been left when the engine temperature or the intake-air temperature or the time duration of exceeding the rpm limit value or the counter value drop below pregiven threshold values.

7. The method of claim 4, wherein the counter value is permanently intermediately stored and, after start of the engine, a start is made with said intermediately stored counter value.

8. The method of claim 4, wherein said counter value is set to a pregiven value including the value 0 when the control unit is taken into service for the first time or after the current supply is interrupted.

9. The method of, claim 1 wherein, in the idle state when the operating state of the hot engine is detected, the idle rpm is increased and, when said operating state is left, the rpm is reduced.

10. The method of claim 9, wherein the rpm is reduced in the next idle cycle.

11. An arrangement for adjusting the idle speed of an internal combustion engine equipped with an adjusting device for adjusting the idle speed, the arrangement comprising:

a first measuring device for detecting the temperature (Tmot) of said engine as a first operating variable thereof;

a second measuring device for detecting the temperature (TANS) of the intake air inducted by said engine as a second operating variable thereof;

a third measuring device for detecting the rpm (Nact) of said engine as a third operating variable thereof;

a control apparatus including a microcomputer connected to said measuring devices to receive said operating variables; said microcomputer being programmed to perform the following steps:

(a) reading in said operating variables;

(b) evaluating said operating variables to determine an operating state of the engine defined by an oil temperature greater than an oil temperature threshold above which an oil pressure is to be expected which is too low to effect an improved cooling of the engine; and, (c) generating a drive signal to drive said adjusting device to increase the idle speed when said operating state is determined to be present; and, circuit means for conducting said drive signal from said microcomputer to said adjusting device thereby actuating said adjusting device to increase said idle speed of said engine.

* * * * *